US008117673B2

(12) United States Patent
Chiang

(10) Patent No.: US 8,117,673 B2
(45) Date of Patent: Feb. 21, 2012

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 886 days.

(21) Appl. No.: 12/155,777

(22) Filed: Jun. 10, 2008

(65) Prior Publication Data

US 2009/0293181 A1 Dec. 3, 2009

(30) Foreign Application Priority Data

May 30, 2008 (TW) ..... 97209602 U

(51) Int. Cl.
*A61F 9/02* (2006.01)

(52) U.S. Cl. ..... 2/248; 2/448

(58) Field of Classification Search ..... 2/426, 428, 2/445, 448, 450

See application file for complete search history.

(56) References Cited

U.S. PATENT DOCUMENTS

| | | | | |
|---|---|---|---|---|
| 5,734,995 | A * | 4/1998 | Chiang | 2/428 |
| 5,896,588 | A * | 4/1999 | Chiang | 2/428 |
| 5,915,540 | A * | 6/1999 | Chou | 2/428 |
| 6,145,133 | A * | 11/2000 | Sato et al. | 2/428 |
| 7,210,175 | B2 * | 5/2007 | Chiang | 2/450 |
| 7,210,715 | B2 * | 5/2007 | Kobayashi | 292/336.3 |

* cited by examiner

*Primary Examiner* — Katherine Moran
(74) *Attorney, Agent, or Firm* — Cheng-Ju Chiang

(57) ABSTRACT

Swimming goggles include two clamp frames, two frame bodies, two lenses respectively received in the receiving slots of the frame bodies, pressing devices for pressing the first arm and the second arm to close, and a head strap. Each clamp frame defines a passageway, and has an assembling portion on an inward side thereof. A first arm and a second arm respectively extend from the clamp frame and opposite to the assembling portion. A slit is defined between joint surfaces of the first arm and the second arm and is located adjacent a user's temple when being worn. A stem extends from an end of the first arm/the second arm. An engaging portion is formed at an end of the stem. The frame bodies are respectively assembled on the passageways of the clamp frames. A receiving slot is defined in an inner surface of each frame body.

13 Claims, 4 Drawing Sheets

SWIMMING GOGGLES

BACKGROUND OF THE INVENTION

1. Field of the Invention

The present invention relates to swimming goggles, and particularly to swimming goggles which are assembled by latching and pressing and which have large side field of vision.

2. Related Art

Swimming goggles have a variety of shapes and structures. In consideration of assembly of lenses, swimming goggles are generally of three types: integrating type, implanting type and pressing type. The integrating type of swimming goggles has lenses integrated with frames. The implanting type of swimming goggles has lenses implanted into and then integrated with frames. The pressing type of swimming goggles has lenses assembled on a mask-like pad and then assembled on and pressed to frames. The instant invention is involved in the pressing type of swimming goggles. A conventional pressing type of swimming goggles have frames with slits for facilitating assembly of lenses, and pressing members for pressing against to join the slits. However, the pressing members of the pressing type are adjacent to a user's cheekbones and hide from the view beside eyes. So the user's eyes can not reach side view except by rotating his/her head. This defect makes the conventional pressing type of swimming goggles not meet product requirement of some countries.

Moreover, because of different profiles of users' heads, users have to pull two strips of a head strap to adjust the swimming goggles to appropriate positions. However, the adjusting positions of the head strap are adjacent to ends of eyes. Once pulling the head strap up and down, the frames are often pulled up and slantwise, making users feel uncomfortable. The frames are also not aligned with the eyes.

SUMMARY OF THE INVENTION

To overcome the shortcomings, an object of the present invention is to provide swimming goggles which touch users closely and are worn comfortably and which have large side field of vision.

The swimming goggles comprise two clamp frames, two frame bodies, two lenses respectively received in the receiving slots of the frame bodies, pressing devices for pressing the first arm and the second arm to close, and a head strap assembled on the engaging portions of the stems. The clamp frames are made of hard material. Each clamp frame defines a passageway, and has an assembling portion on an inward side thereof. A first arm and a second arm respectively extend from an outward side of the clamp frame and opposite to the assembling portion. A slit is defined between joint surfaces of the first arm and the second arm and is located adjacent a user's temple when being worn. A stem extends from an end of the first arm/the second arm and has appropriate length. An engaging portion is formed at an end of the stem. A connecting member connects the assembling portions of the clamp frames. The frame bodies are made of soft material, and are respectively assembled on the passageways of the clamp frames. Each frame body includes an outer surface and an inner surface. A receiving slot is defined in the inner surface.

The slits are neighboring a user's temples, broadening side area of the lenses. Side areas of lenses are enlarged, allowing a user's eyes to reach side vision. When the swimming goggles are worn, the stems are located at about a user's ears, retaining the frame bodies and the lenses. Therefore the head strap is pulled in balance, avoiding the frame bodies inclined.

DESCRIPTION OF THE PREFERRED EMBODIMENTS

Figure 1:
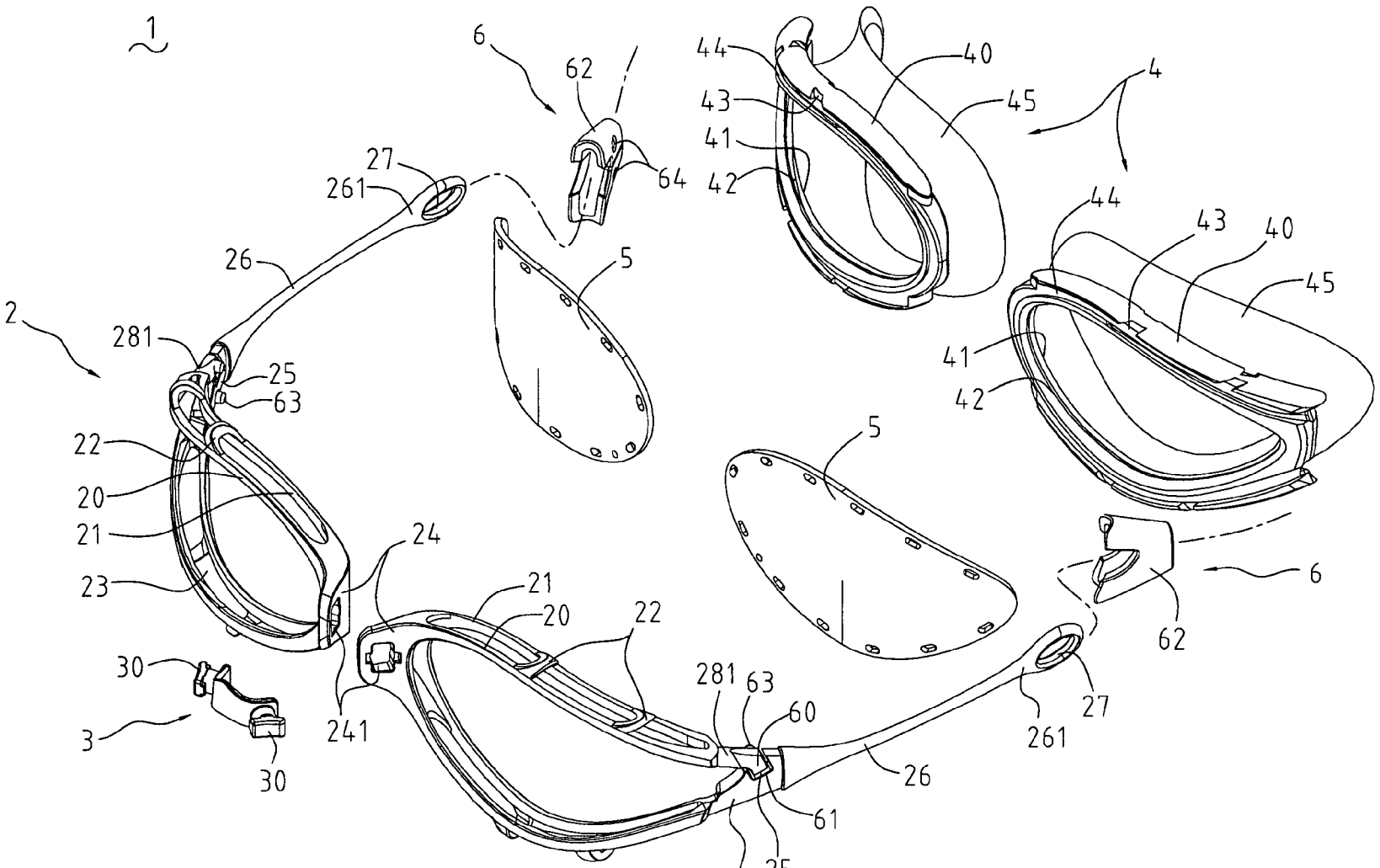
FIG. 1 is an exploded view of swimming goggles of the present invention.

With reference to FIG. 1, swimming goggles 1 in accordance with the present invention comprise two clamp frames 2, a connecting member 3, two frame bodies 4, two lenses 5 and pressing devices 6. Each clamp frame 2 is made of hard material, and includes a first ring 20 and a second ring 21 corresponding to each other. A plurality of ribs 22 are spaced the same distance from each other and are parallel to each other for connecting the first ring 20 and the second ring 21. A passageway 23 is defined between the first ring 20 and the second ring 21 for receiving the frame body 4. Each clamp frame 2 has an assembling portion 24 on an inward side thereof for connecting with the connecting member 3. A first arm 281 and a second arm 282 respectively extend from an outward side of the clamp frame 2 and are opposite to the assembling portion 24. The first arm 281 and the second arm 282 extend toward each other to form a tapered portion 28. A slit 25 is defined between the joint surfaces of the first arm 281 and the second arm 282. Preferably, the slits 25 are inclined upwardly. A stem 26 extends unitarily from an end of the second arm 282, and has appropriate length. The stem 26 has a distal portion 261 located near a user's ear when the swimming goggles are worn. An engaging portion 27 is unitarily formed at an end of the stem 26. In this embodiment, the engaging portion is a ring button. In another embodiment, the engaging portion 27 may be a ring button, a strap buckle, or an assembly of a ring button and a strap buckle. A head strap (not shown) is assembled on the engaging portions 27.

The assembling portions 24 are assembled with the connecting member 3. The connecting member 3 forms positioning posts 30 on both sides thereof. Each of the positioning posts 30 has a T-shaped cross section. The assembling portions 24 define embedding grooves 241 for rotating to latch with the positioning posts 30. The embedding grooves 241 are grooves with cross-like section. When assembled, the T-shaped positioning posts 30 fit to the assembling portions 24, and rotate 90 degrees to latch with the assembling portions 24.

The frame bodies 4 are made of soft material, and are respectively assembled on the passageways 23 of the mesh-like clamp frames 2. Each frame body 4 includes an outer surface 40 and an inner surface 41. A receiving slot 42 is defined in the inner surface 41 for receiving the lenses 5. A plurality of positioning grooves 43 are defined in the outer surface 41 for corresponding to the ribs 22 of the clamp frames 2. Each frame body 4 defines a latch groove 44 for locking rims of the first ring 20 and the second ring 21. A pad 45 extends unitarily from a side of the inner surface 41 for touching a user's face comfortably.

Each pressing device 6 comprises an embedding portion 60 and a latch portion 61 locking with each other. The embedding portion 60 extends unitarily from an end of the first arm 281 and then inclines towards the latch portion 61 to form a projection (not labeled). The latch portion 61 extends unitarily from an end of the second arm 282, and defines a locking groove (not labeled) for corresponding to the projection. The embedding portion 60 and the latch portion 61 shift the joint surfaces between the first arm 281 and the second arm 282. The slit 25 shifts to between the embedding portion 60 and the latch portion 61. In assembly, the projection of the embedding portion 60 locks and is joined with the locking groove of the latch portion 61 so as to close the slit 25 and urging to urge the first arm 281 and the second arm 282 to be assembled together. It is noted that the slit 25 is located adjacent a user's temple, and therefore, the lenses 5 have enlarged side area with either side of the clamp frame 2 being enlarged. Consequently, a user can have enlarged side visual field.

The slit 25 is further pressed, and the first arm 281 and the second arm 282 are assembled fixedly. Each pressing device 6 further comprises a pressing member 62, and positioning protuberances 63 and orifices 64 engaging with each other. The pressing member 62 is hollow and tapered, and extends around the stem 26 to gradually press against the first arm 281 and the second arm 282, thereby further pressing the slit 25 to close. The positioning protuberances 63 are formed on sides of the first arm 281 and the second arm 282, respectively. The orifices 64 are formed on the pressing member 62. When assembled, the positioning protuberances 63 and the orifices 64 engage with each other. The pressing member 62 is assembled on the first arm 281 and the second arm 282, and reinforces assembly of the first arm 281 and the second arm 282.

Figure 2:
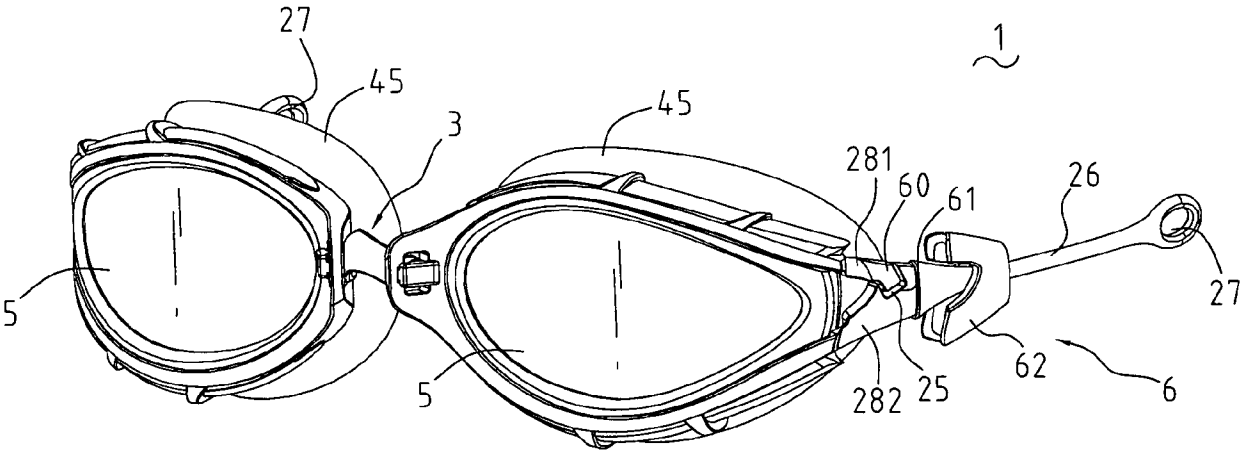
FIGS. 2-4 illustrate the swimming goggles being assembled step by step.
Figure 3:
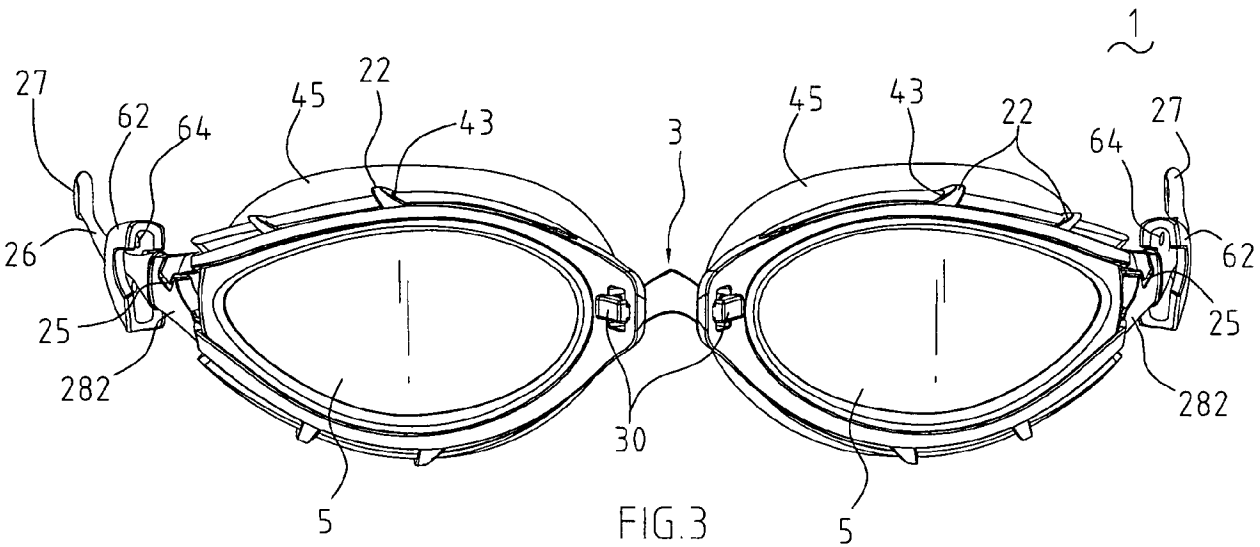
Figure 4:
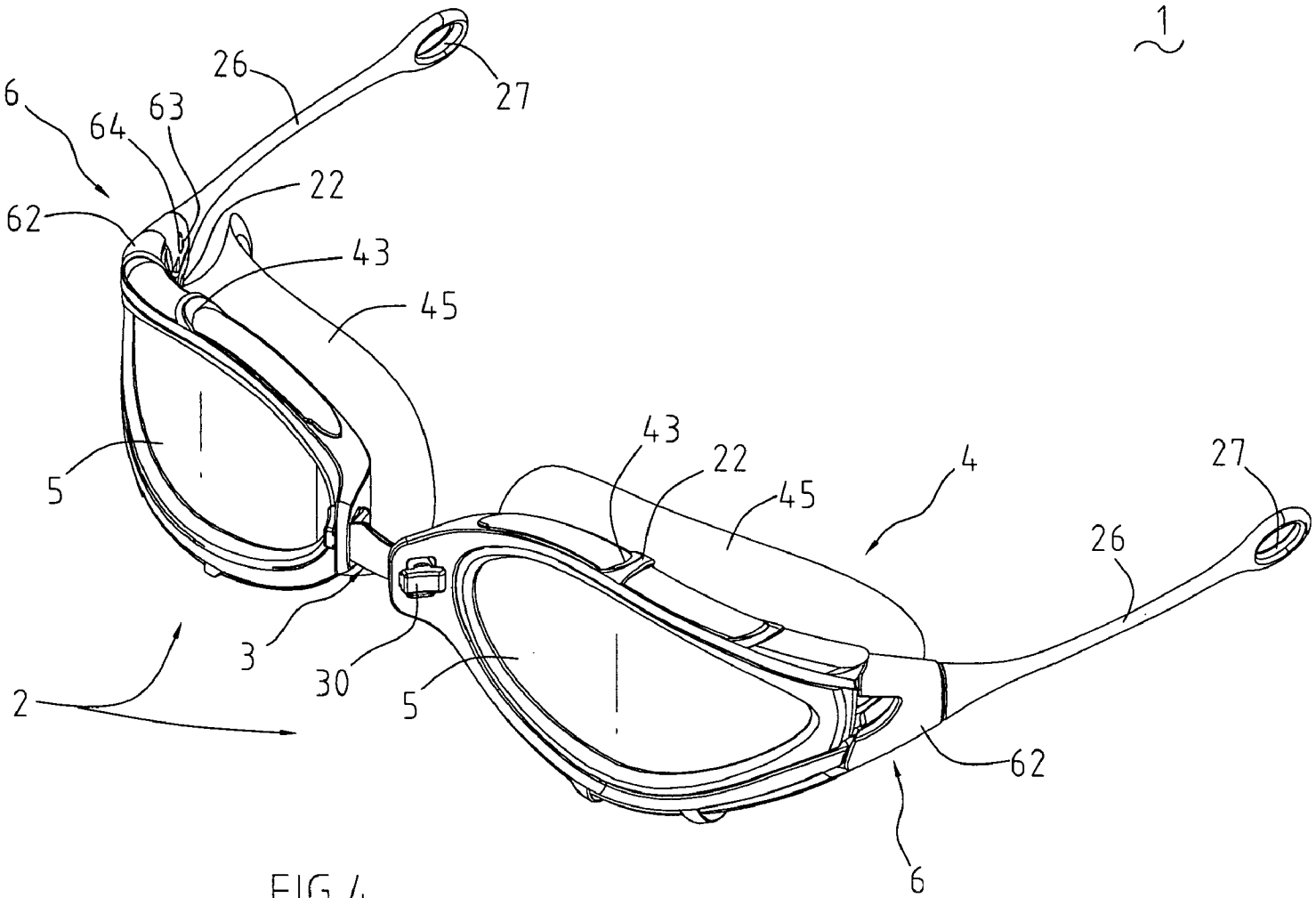

In assembly, the lenses 5 are respectively received in the receiving slots 42 of the frame bodies 4. The frame bodies 4 are respectively assembled on the passageways 23 of the clamp frames 2. During assembly, the ribs 22 of the clamp frames 2 slide into the positioning grooves 43 since the outer surfaces 40 of the frame bodies 4 are arcuate. The first ring 20 and the second ring 21 are embedded into the latch groove 44 of the frame bodies 4. The frame bodies 4 and the lenses 5 are assembled onto the clamp frames 2. As shown in FIGS. 2 and 3, the pressing devices 6 extend around the stems 26, and press against the tapered portions 28 to urge the slits 25 to close. The positioning protuberances 63 and the orifices 64 engage with each other for assembling the pressing members 60 onto the tapered portions 28, thereby reliably pressing the slits 25 to close. FIG. 4 shows the swimming goggles of the present invention being assembled completely.

Figure 6:
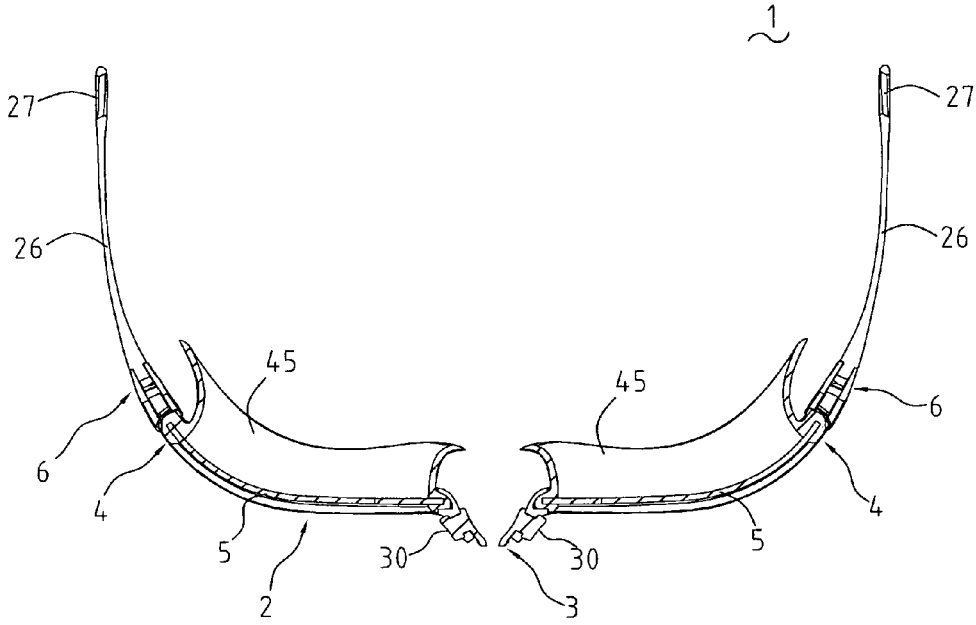
FIG. 6 is a cross-sectional view taken along the line 6-6 in FIG. 5.
Figure 5:
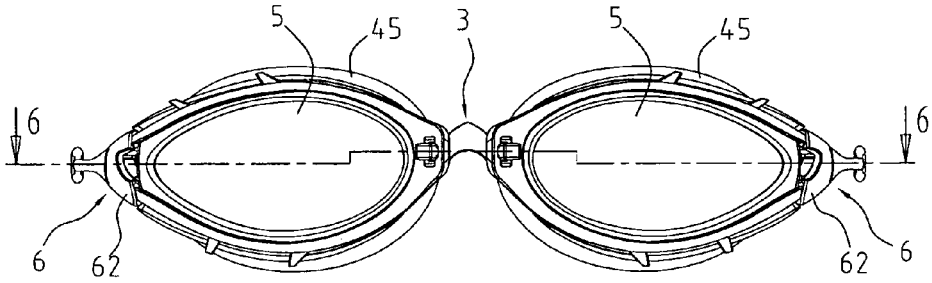
FIG. 5 is a front view of the swimming goggles of FIG. 4.

Further referring to FIGS. 5 and 6, in assembly, the frame bodies 4 and the lenses 5 are effectively clamped and pressed by the clamp frames 2, the embedding portions 60, the latch portions 61, the pressing members 60, the positioning protuberances 63 and the orifices 64. When the swimming goggles are worn, the stems 26 are located at about a user's ears, like brackets of lenses, retaining the frame bodies 4 and the lenses 5 in the front. Two strips of a head strap (not labeled) are pulled in balance, avoiding the frame bodies 4 inclined. The slits 25 are neighboring a user's temples, broadening side area of the lenses 5. Side areas of lenses are enlarged, allowing a user's eyes to reach side vision.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

two clamp frames being made of hard material, and defining a passageway, each clamp frame having an assembling portion on an inward side thereof, a first arm and a second arm respectively extending from the clamp frame and opposite to the assembling portion, a slit being defined between joint surfaces of the first arm and the second arm and being located adjacent a user's temple when being worn, a stem extending from an end of the first arm or the second arm and having appropriate length, an engaging portion being formed at an end of the stem, a connecting member connecting the assembling portions of the clamp frames;

two frame bodies being made of soft material, and being respectively assembled on the passageways of the clamp frames, each frame body including an outer surface and an inner surface, a receiving slot being defined in the inner surface;

two lenses being respectively received in the receiving slots of the frame bodies;

pressing devices placed at and pressing the first arm and the second arm to be close to each other; and a head strap assembled on the engaging portions of the stems;

wherein each of the pressing devices comprises an embedding portion, a latch portion locking with the embedding portion, and a pressing member, the embedding portion being formed on the first arm, the latch portion being formed on the second arm, the first and second arms extending toward each other to form a tapered portion, and the pressing member being hollow and tapered and extending around the stem to gradually press against the first and second arms.

2. The swimming goggles as claimed in claim 1, wherein the embedding portion extends unitarily from an end of the first arm and then inclines towards the latch portion to form a projection, wherein the latch portion extends unitarily from an end of the second arm and defines a locking groove for corresponding to the projection, and wherein the projection of the embedding portion locks and is joined with the locking groove of the latch portion during assembly so as to close the slit and to urge the first arm and the second arm to be assembled together.

3. The swimming goggles as claimed in claim 2, wherein the slit is inclined upwardly.

4. The swimming goggles as claimed in claim 3, wherein the stem extends from an end of the second arm and has a distal portion located near a user's ear when the swimming goggles are worn.

5. The swimming goggles as claimed in claim 1, wherein the engaging portion is selected from the group consisting of a ring button, a strap buckle, and an assembly of a ring button and a strap buckle.

6. The swimming goggles as claimed in claim 5, wherein the engaging portion is a ring button unitarily formed at an end of the stem.

7. The swimming goggles as claimed in claim 1, wherein the pressing device further comprises positioning protuberances and orifices engaging with each other, the positioning protuberances being respectively formed on sides of the first arm and the second arm, and the orifice being formed on the pressing member.

8. The swimming goggles as claimed in claim 1, wherein the connecting member forms positioning posts on both sides thereof, and wherein the assembling portions of the clamp frames define embedding grooves for rotating to latch with the positioning posts.

9. The swimming goggles as claimed in claim 8, wherein each of the positioning posts has a T-shaped cross section, and the T-shaped positioning posts fit to the assembling portions and rotate 90 degrees to be latched with the assembling portions during assembly.

10. The swimming goggles as claimed in claim 1, wherein each clamp frame includes a first ring and a second ring corresponding to each other, a plurality of ribs connecting the first ring and the second ring.

11. The swimming goggles as claimed in claim 10, wherein a plurality of positioning grooves are defined in the outer surface for corresponding to the ribs of the clamp frames, and each frame body defines a latch groove for locking rims of the first ring and the second ring.

12. The swimming goggles as claimed in claim 11, wherein the ribs are spaced the same distance from each other and are parallel to each other.

13. The swimming goggles as claimed in claim 1, wherein a pad extends unitarily from a side of the inner surface.

* * * * *